United States Patent [19]

Gallagher

[11] Patent Number: 5,042,457

[45] Date of Patent: Aug. 27, 1991

[54] GREASE EXTRACTION VENTILATOR APPARATUS

[76] Inventor: Arlen W. Gallagher, 6575 Fenton St., Arvada, Colo. 80003

[21] Appl. No.: 498,609

[22] Filed: Mar. 26, 1990

[51] Int. Cl.[5] ..... F24C 15/20

[52] U.S. Cl. ..... 126/299 E; 55/240; 55/DIG. 36

[58] Field of Search ..... 126/299 R, 299 D, 299 E, 126/21 R; 55/DIG. 36, 240

[56] References Cited

U.S. PATENT DOCUMENTS

| | | | |
|---|---|---|---|
| 2,546,259 | 3/1951 | Fenn | 55/240 |
| 3,731,462 | 5/1973 | Costarella et al. | 55/DIG. 36 |
| 3,786,739 | 1/1974 | Wright | 126/299 E |
| 4,011,802 | 3/1977 | Molitor et al. | 126/299 D |
| 4,124,021 | 11/1978 | Molitor | 126/299 E |
| 4,351,652 | 9/1982 | Wisting | 126/299 E |
| 4,407,266 | 10/1983 | Molitor | 126/299 E |

*Primary Examiner*—James C. Yeung
*Attorney, Agent, or Firm*—John E. Reilly

[57] ABSTRACT

A grease extraction system includes an outer housing including a lower entrance passage and an upper exit duct for drawing the exhaust air stream upwardly through a scrubbing chamber, and a water supply manifold directs the water into the exhaust stream at the chamber area in such a way as to create a vortex of water droplets in the exhaust stream to encourage the extraction of grease, fumes and other contaminants from the stream.

13 Claims, 2 Drawing Sheets

GREASE EXTRACTION VENTILATOR APPARATUS

This invention relates to grease extraction devices; and more particularly relates to a novel and improved grease extraction ventilator apparatus adapted for use with cooking appliances, such as, stoves, ranges, broilers and the like.

BACKGROUND AND FIELD OF THE INVENTION

This invention is directed to improvements in ventilating systems of the type disclosed in U.S. Pat. Nos. 3,841,062 and 4,129,179, both assigned to the assignee of this invention. One purpose of the '062 patent was to extract grease and cooking vapors as they are produced, and to reduce their deposition on the interior walls of the ventilator. Although the system of the '062 patent has proven highly effective in use, it required upward lifting of water from a reservoir in the bottom and therefore a higher static pressure rating of the exhaust fan to agitate and lift the water up into the scrubbing chamber area; and further utilized a downwardly and forwardly extending lower wall which tended to create an entrapment area for grease. Moreover, exact adjustment of the air inlet baffle was necessary for suspension of the water in the air/exhaust stream for most efficient grease extraction.

Other representative patents of interest are U.S. Pat. Nos. 3,055,285 to Gaylord; 3,624,696 to Cohen et al; 3,731,462 to Costarella et al; 3,943,836 to Kuechler and 4,071,019 to King. Although these patents are of interest insofar as ventilator systems are concerned, none discloses a truly effective means for extraction of contaminants through the use of cold water for cooling the metal walls, reducing exhaust air temperatures, or the condensation of grease vapors through cooling by water droplets/mist. Among other problems, it has been found that the air inlet baffles could be mistakenly set too high so as to negate the required air flow velocity to cause agitation of the water bath resulting in minimal splashing effect and inadequate grease extraction.

It is desirable to provide a ventilator system in which the grease vapors and lint can be removed without a water reservoir or grease entrapment area at the bottom as well as to avoid accumulation on the interior walls of the ventilator and particularly to avoid baked-on grease deposits which will prevent water from absorbing heat from the walls of the ventilator. Furthermore, it is desirable to avoid the necessity of critical adjustment of an air inlet baffle to accommodate varying air volume flows. It is further desirable to provide a ventilator system which is capable of suspending the water in the exhaust air stream above the air inlet baffles by introducing water above the air inlet so that it is free to undergo gravity flow in sheet form downwardly into the path of the upwardly flowing airstream resulting in turbulent circular motion of the water across the substantial extent of the air inlet area independently of the exhaust air flow volume, within limits, and the positioning of the air inlet baffles.

SUMMARY OF THE INVENTION

It is therefore an object of the present invention to provide for a novel and improved grease extraction ventilator adaptable for use with cooking equipment and the like.

Another object of the present invention is to provide for a novel and improved method and means for extracting grease and cooking vapors as they are produced, rather than permitting them to become deposited on the interior walls of the ventilator or entrapment areas.

A still further object of the present invention is to provide a ventilator apparatus which generates a sheet or film of water which is suspended and recirculated by a flow of air, thereby efficiently and continuously removing grease vapors, lint and other contaminants by centrifugal force, entrapment and condensation.

Yet another object of the invention is to provide a ventilator system which reduces the temperature of the exhaust air, which ventilator is relatively quiet in operation, and in which any fire hazard is effectively reduced.

A still further objection of this invention is to provide a ventilator apparatus which uses a minimal amount of water while providing increased grease extraction efficiency over the prior art.

An additional object of this invention is to provide constant and adequate water filtration while avoiding the necessity of changing or adjustment of exhaust air flow volume and air inlet baffle position.

In accordance with the present invention, a ventilating system has been devised for extracting grease, fumes and contaminants from the exhaust stream of a cooking appliance, the system comprising a hood or housing, means for inducing the flow of the exhaust stream through an entrance in the housing, and means for injecting water into the exhaust stream within the housing and in countercurrent relation to the flow of the exhaust stream whereby to create a vortex of water droplets in the exhaust stream for cooling exhaust air, and for the extraction of grease, fumes and other contaminants from the air stream.

In accomplishing the foregoing, the fresh water supply is introduced above the air inlet and by gravitation will move downwardly along an air inlet baffle where it slides off horizontally into the vertically upward path of the exhaust air stream. The exhaust air moving upwardly through the air inlet passage between the air inlet baffle and back wall of a scrubbing chamber is intercepted by the flow of water moving horizontally away from the air inlet baffles thereby lifting the water upwardly and through a narrow channel formed by an air inlet baffle and back wall of the scrubbing chamber. As the volume of water suspended in the exhaust air stream increases the weight of the water against the upward air movement will cause its natural spread in a horizontal direction resulting in an even distribution of recirculated water throughout the entire length of the unit. When the weight of water suspended within the air stream reaches the maximum amount that can be supported, it is free to drain downwardly along the rear wall of the scrubbing chamber into a full width trough; the excess water together with any entrained contaminants may then be suitably carried away through a conventional drain into the building drainage system through the length of the cooking area.

The above and other objects of the present invention will become more readily appreciated and understood from a consideration of the following detailed description of a preferred embodiment when taken together with the accompanying drawings wherein:

DETAILED DESCRIPTION OF THE PREFERRED EMBODIMENT

Figure 1:
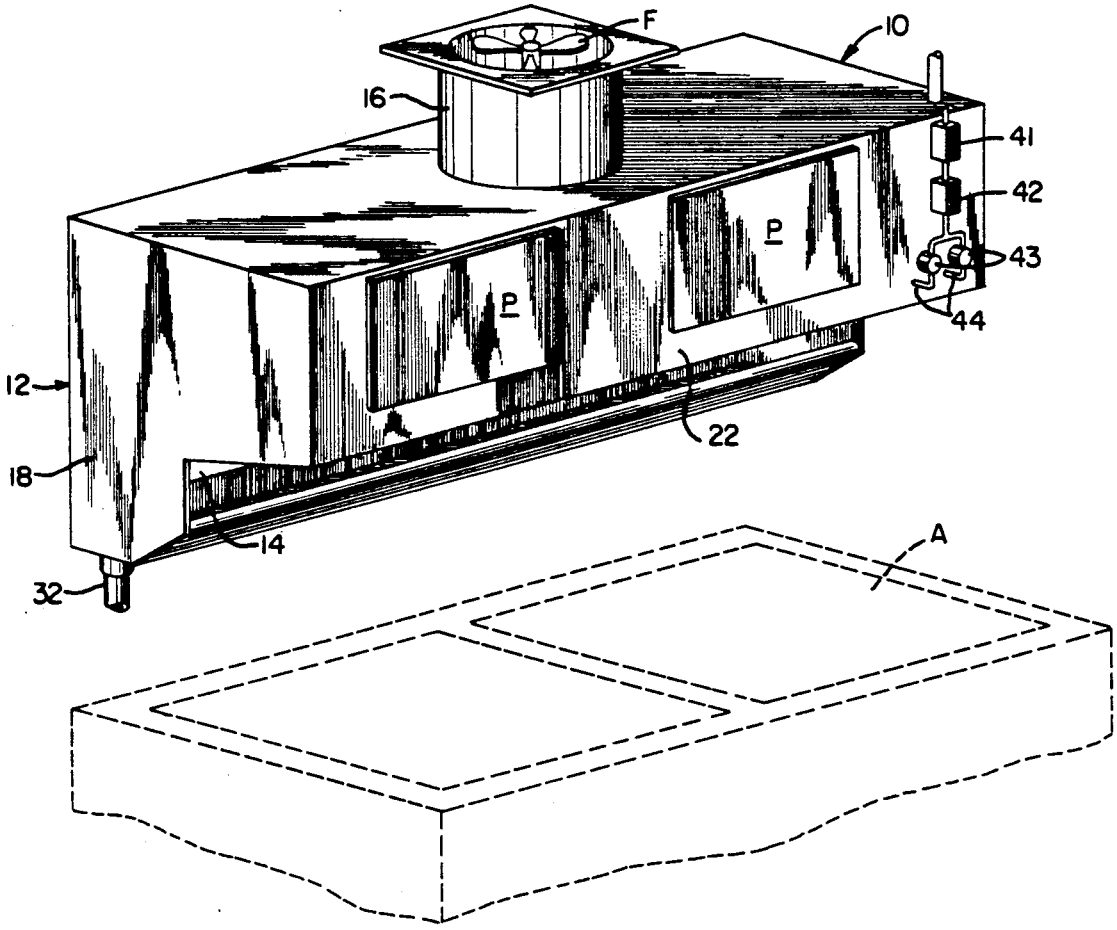
FIG. 1 is a perspective view of the ventilating system in accordance with the present invention.

Referring in more detail to the drawings, a preferred form of ventilator apparatus 10 is installed in a conventional manner above a cooking appliance A and is made up broadly of a hood or housing 12 having a lower inlet passage area 14 and an upper exhaust duct 16. In a well-known manner, the exhaust duct or collar 16 is connected into the flue of a chimney or other exhaust system available in the building, and an exhaust fan F is appropriately installed to induce the upward flow of exhaust fumes, vapors and contaminants generated by the cooking appliance through the air inlet passage 14.

Figure 2:
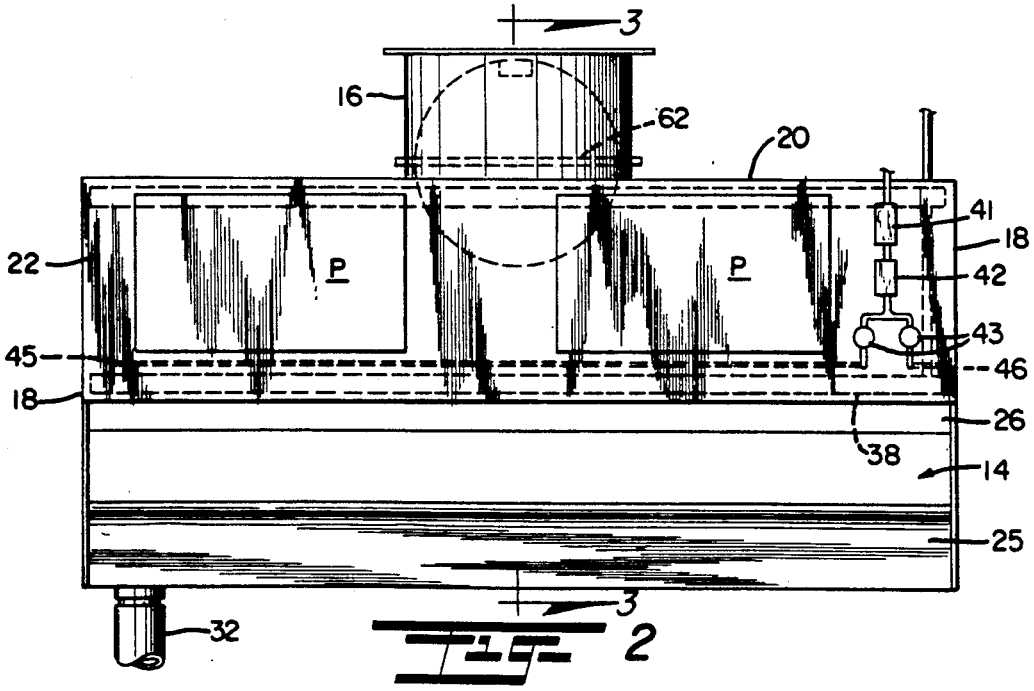
FIG. 2 is a front elevation of the ventilating system shown in FIG. 1.
Figure 3:
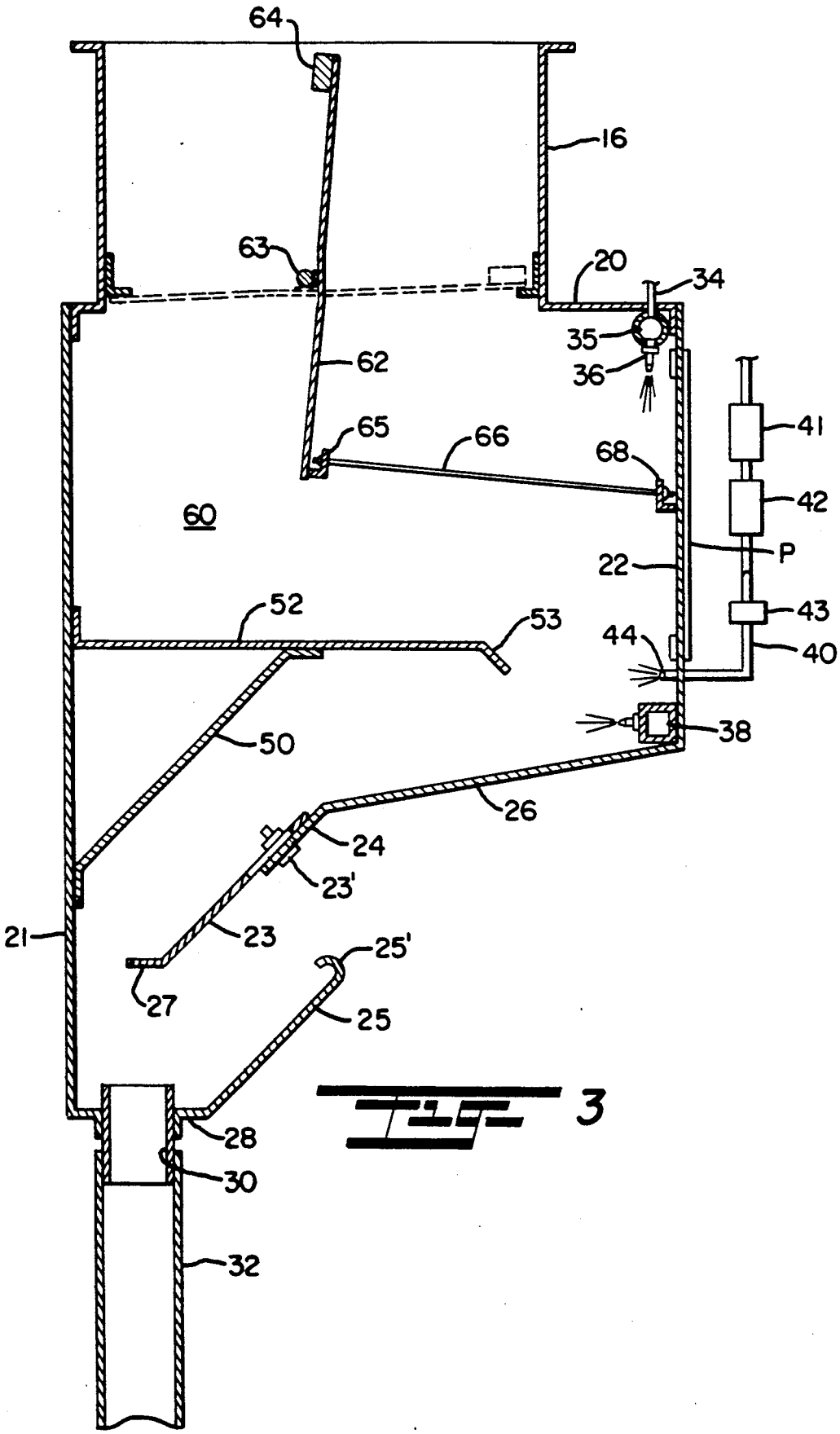
FIG. 3 is an enlarged cross-sectional view taken about lines 3—3 of FIG. 2.

In the preferred form, the hood 12 is of generally rectangular configuration and elongated to traverse the substantial width of the cooking appliance and with the air inlet passage centered in spaced relation above the appliance. As shown in FIGS. 1 and 2, the exterior of the hood 12 includes opposite end walls 18, a top horizontal wall 20 and rear and front vertical walls 21 and 22 extending between the end walls 18. The air inlet passage 14, as best seen from FIG. 3, is formed between spaced, parallel, upper and lower inclined panel sections 24 and 25, respectively. Lower panel 25 terminates in a reverse curved lip 25' facing inwardly toward the air passage 14 and upwardly toward the panel or baffle member 24. A lower inclined wall 26 is directed at a relatively low angle away from the front vertical wall 22, and an adjustable baffle plate member 23 forms a continuation of the panel 24 and is slidable toward or away from the rear wall 21 by loosening set screws 23' which releasably lock the baffle members 23 and 24; and the plate 23 terminates in a horizontal ledge 27 in closedly spaced relation to the rear wall 21. The lower panel 25 inclines forwardly and upwardly away from a horizontal support panel 28 at the lower edge of the rear wall 21, and a bottom through or drain 30 extends from the panel 28 into a drain pipe 32 through which any excess water together with collected grease, fumes and contaminants are removed through the lower end of the hood 12.

The hot water inlet 34 is directed into manifold 35 at the upper interior corner of the top wall 20 and front wall 22; and the manifold 35 includes downwardly extending nozzles 36 which traverse the length of the front wall 22 directly beneath and supported by the top wall 20. Another hot water feed pipe 38 is positioned at the interior lower corner between the front wall 22 and lower wall 26 and is provided with a series of horizontally directed nozzles 39. A cold water feed pipe 40 includes a line strainer 41, metering valve 42 and needle valve 43 for directing cold water under pressure through a horizontal pipe or manifold 44 located directly above the hot feed pipe 38. The valves 42 and 43 are preset to regulate the amount of water flowing into the manifold. The pipe 44 also traverses the length of the hood and has opposite discharge ends 45 and 46 for discharging water into opposed lower interior corners between the end walls 18 and front wall 22 of the hood.

An important feature of the present invention resides in a scrubbing chamber which is formed directly above and in communication with the air inlet passage 14. An air deflector panel 50 extends upwardly and forwardly away from the rear wall 21 in spaced, substantially parallel relation to the panel 24, and the panel 50 functions also as a bracket support for the horizontal deflector panel or plate 52 which extends forwardly away from the rear wall 21 and terminates in a downwardly directed lip 53. The horizontal panel 52 forms a horizontal extension of the inclined deflector plate 50 and, together with the plate 50, defines a forwardly convergent scrubbing chamber or area for intermixing of the exhaust air stream from the cooking appliance with the water droplets from the cold water manifold 44.

An upper open plenum area 60 is formed by the outer walls of the hood 12 above the scrubber chamber and specifically above the horizontal deflector 52 and, in accordance with conventional practice, a safety damper 62 is pivotally supported on a pivot rod 63 for movement between an open vertical position as shown in full in FIG. 3 and a horizontal closed position and a dotted line position across the lower end of the exhaust duct 16. A weight 64 is disposed at one edge of the damper 62, and a hook 65 at the opposite lower edge with a fuse link cable 66 extending from the hook 65 to another hook 68 on the inner surface of the front wall 22. Normally, the cable 66 will maintain the damper in the vertical open position as shown in full; however, in the event of a fire, the fuse link attached cable 66 will disintegrate when exposed to a predetermined temperature level thereby releasing the damper for pivotal movement into the closed position.

In practice, when the exhaust fan is turned on, a main control valve, not shown, is opened to release cold water for downward movement along the wall 26 into the scrubbing chamber area as defined. The exhaust air stream is drawn initially in a downward direction through the inlet passage 14, then is caused to undergo a reversal in flow around the lower edge of the panel 24 and advance upwardly through the scrubbing chamber. As the air flow turns upwardly and advances past the the downward flow of water and draw the water upwardly to a level adjacent to lip 53 where the air velocity decreases and allows the water to fall in a somewhat circular path toward walls 22 and 26. As the water continues to move downwardly along the lower wall 26 in countercurrent relation to the flow of air it will once again be picked up by the flow of air thereby creating a vortex action with the water in continuous suspension in the air stream. The volume of water in suspension will vary in accordance with the air flow volume and the setting of the air inlet baffle plate 23. When the scrubbing chamber has absorbed the maximum capacity of water into the air, any excess water will escape from the chamber and advance along the panel 21 into the lower trough or drain section 28, and the water will tend to collect any grease vapors or other contaminants and carry the contaminants away with it as it is drained off through the bottom, particularly any of the heavier or solidified particles of grease.

Typically, the ventilator system will run continuously in a commercial establishment and, at the end of the day, when the exhaust fan is shut off, the water held in suspension will drain into the drain system. The hot water manifolds 35 and 38 contain a detergent to flush the scrubbing chamber and total interior of the hood. After the cleaning cycle is completed or the exhaust fan turned on, fresh water will then refill the scrubbing chamber to form a continuous water filter as described.

It will be evident from the foregoing that any necessary adjustments to the baffle plate 23 and valves 42, 43 can be made at the time of installation according to mass flow rate of air from the working equipment. The cold water released at opposite ends 45 and 46 of the housing will migrate across the entire length of the panel 26 to effectively form a continuous sheet or stream of water flowing across the length of the panel 26 and downwardly toward the scrubbing chamber so that a water filter is formed effectively along the length of the housing. Removal access panels P are provided on the front wall 22 in order to gain entry into the interior plenum area 60 for maintenance or repair and periodic cleaning of the interior of the hood 12.

It is therefore to be understood that while a preferred embodiment of the present invention is set forth and described herein, various modifications and changes may be made without departing from the spirit and scope of the present invention as defined by the appended claims and reasonable equivalents thereof.

I claim:

1. A ventilating system for extracting grease, fumes and solid particles from an exhaust air stream created by a cooking appliance, said ventilating system comprising:

a housing includes an entrance passage and baffle means in said housing;

means for inducing the flow of said exhaust air stream through said entrance passage and said baffle means, said baffle chamber having a pair of spaced diverter panels and a baffle member therebetween to cause reversal in the direction of flow of said exhaust stream, said housing including a lower substantially horizontal wall merging into said baffle member, said baffle member inclining downwardly and rearwardly to terminate in a horizontal ledge at a lower terminal edge thereof; and means for injecting water into said housing from a location above said entrance passage in countercurrent relation to the flow of the exhaust stream through said baffle means whereby to cooperate with said baffle means to create a vortex of water droplets and air in the path of flow of said exhaust air stream through said housing.

2. A ventilating system according to claim 1 wherein said baffle means is adjustable to vary the size of said entrance passage in said housing through which said exhaust air stream enters.

3. A ventilating system according to claim 1 wherein said water injection means is activated to inject water in sheet form downwardly into a scrubbing chamber along the interior of said housing.

4. A ventilating system for extracting grease, fumes and contaminants from the exhaust air stream of a cooking appliance, said ventilating system comprising:

a housing having a baffle chamber, an entrance passage for said exhaust air stream, and an exit duct, said baffle chamber having a pair of spaced diverter panels and a baffle member therebetween to cause reversal in the direction of flow of said exhaust stream, said housing including a lower substantially horizontal wall merging into said baffle member, said baffle member inclining downwardly and rearwardly to terminate in a horizontal ledge at a lower terminal edge thereof;

means for inducing the upward flow of said exhaust air stream through said baffle chamber;

means for injecting water in sheet form downwardly along one of said wall portions of said baffle chamber in countercurrent relation to the flow of the exhaust air stream whereby to cooperate with said baffle member to create a vortex of water droplets and air in the path of flow of said exhaust air stream through said chamber; and means for collecting and draining said grease, fumes and contaminants along with any excess water in said exhaust air stream from the bottom of said chamber.

5. A ventilating system according to claim 4 wherein said means for injecting water into said chamber operates continuously and concurrently with said means for inducing flow of said exhaust air stream through said chamber.

6. A ventilating system according to claim 5 wherein said means for injecting water in said chamber includes water discharge pipes at opposite ends of said chamber.

7. In a ventilating system for extracting grease, fumes and contaminants from the exhaust air stream of a cooking appliance wherein a housing includes a lower entrance passage for said exhaust stream, a front wall, rear wall, opposite end walls defining a common enlarged plenum area, and an exit duct including means for inducing the flow of said exhaust air stream upwardly through said housing, the improvement comprising:

baffle means in said housing including a pair of spaced diverter panels and a baffle member therebetween to cause reversal in the direction of flow of said exhaust air stream from said entrance passage upwardly into a reduced cross-sectional area in communication with said enlarged plenum area, said housing including a lower substantially horizontal wall extending rearwardly from said front wall and merging into said baffle member, said baffle member inclining downwardly and rearwardly away from said lower wall, and a horizontal ledge at a lower terminal edge of said baffle member;

means for injecting water in sheet form downwardly for gravity flow into said reduced cross-sectional area in countercurrent relation to the upward path of flow of the exhaust air stream therethrough whereby to cooperate with said baffle means in creating a vortex of water droplets and air in the path of flow of said exhaust stream; and means for collecting and draining grease, fume and contaminants along with any excess water in said reduced cross-sectional area for removal from said housing.

8. In a ventilating system according to claim 7, one of said diverter panels including a horizontal deflector plate extending forwardly above and in spaced relation to said baffle member.

9. In a ventilating system according to claim 8, said deflector plate including a downwardly inclined lip at the front edge thereof.

10. In a ventilating system according to claim 7, said baffle means including an adjustable baffle plate member movable in a direction to modulate the cross-sectional area between said entrance passage and said reduced cross-sectional area, said adjustable baffle plate member including a lower edge in spaced facing relation to said rear wall.

11. In a ventilating system according to claim 7, said spaced diverter panels disposed in substantially parallel relation to one another and inclining upwardly in a forward direction to define upper and lower inclined deflector panels, said lower deflector panel having a reverse curved edge at an upper end thereof.

12. In a ventilating system according to claim 7, said water injecting means including a manifold extending along said front wall and terminating in opposite discharge ends interiorly of said front wall, and valve control means for regulating the flow rate of water injected through said manifold.

13. In a ventilating system according to claim 7, including a detergent/water injection system for cleaning the interior of said housing.

* * * * *

UNITED STATES PATENT AND TRADEMARK OFFICE

CERTIFICATE OF CORRECTION

PATENT NO. : 5,042,457

DATED : 27 August, 1991

INVENTOR(S) : Arlen W. Gallagher

It is certified that error appears in the above-identified patent and that said Letters Patent is hereby corrected as shown below:

| Column | Line No. | |
|---|---|---|
| 3 | 46 | cancel "through" and substitute -- trough --. |
| 4 | 42 | after "the" (second occurrence), insert -- the deflector lip 27, it will move into contact with --. |

Signed and Sealed this

Second Day of March, 1993

*Attest:*

STEPHEN G. KUNIN

*Attesting Officer*

*Acting Commissioner of Patents and Trademarks*